US012152588B1

(12) United States Patent
Kenny et al.

(10) Patent No.: US 12,152,588 B1
(45) Date of Patent: Nov. 26, 2024

(54) FREE-MOLD STATOR FOR A PROGRESSING CAVITY PUMP

(71) Applicant: Grant Prideco, Inc., Wilmington, DE (US)

(72) Inventors: Paula Kenny, Marple (GB); Michael Davies, Stockport (GB)

(73) Assignee: Grant Prideco, Inc., Wilmington, DE (US)

( * ) Notice: Subject to any disclaimer, the term of this patent is extended or adjusted under 35 U.S.C. 154(b) by 0 days.

(21) Appl. No.: 18/324,659

(22) Filed: May 26, 2023

(51) Int. Cl.

| | |
|---|---|
| ***F04C 29/00*** | (2006.01) |
| ***F01C 1/10*** | (2006.01) |
| ***F01C 5/04*** | (2006.01) |
| ***F01C 21/10*** | (2006.01) |
| ***F04C 2/107*** | (2006.01) |
| ***F04C 13/00*** | (2006.01) |
| ***F04C 15/00*** | (2006.01) |

(52) U.S. Cl.
CPC ..... *F04C 2/1075* (2013.01); *F04C 29/00* (2013.01); *F04C 2240/10* (2013.01); *F04C 2240/30* (2013.01); *F04C 2240/802* (2013.01)

(58) Field of Classification Search
CPC ..... F04C 2/1075; F04C 29/00; F04C 13/008; F01C 5/04
See application file for complete search history.

(56) References Cited

U.S. PATENT DOCUMENTS

| | | | |
|---|---|---|---|
| 3,011,445 | A | 12/1961 | David |
| 5,620,313 | A | 4/1997 | Fockenberg |
| 6,155,807 | A | 12/2000 | Fenton |
| 7,556,214 | B2 | 7/2009 | Parrett et al. |
| 8,215,014 | B2 | 7/2012 | Amburgey |
| 8,257,633 | B2 | 9/2012 | Sindt et al. |
| 8,439,659 | B2 | 5/2013 | Loeker et al. |
| 8,764,420 | B2 | 7/2014 | Overmeier et al. |
| 8,967,948 | B2 | 3/2015 | Hashima et al. |
| 9,683,566 | B2 | 6/2017 | Bindig et al. |
| 9,719,506 | B2 | 8/2017 | Kamal et al. |
| 10,161,397 | B2 | 12/2018 | Dicks et al. |
| 10,648,337 | B2 | 5/2020 | Overmeier et al. |
| 10,717,612 | B2 | 7/2020 | Rickers et al. |

(Continued)

FOREIGN PATENT DOCUMENTS

| | | | |
|---|---|---|---|
| AU | 2007221859 | A1 | 4/2009 |
| AU | 2015357838 | A1 | 7/2017 |

(Continued)

OTHER PUBLICATIONS

English copy of WO2012090968 by PE2E Aug. 31, 2023.*

(Continued)

*Primary Examiner* — Deming Wan
(74) *Attorney, Agent, or Firm* — Schwegman Lundberg & Woessner, P.A.

(57) ABSTRACT

A free-mold stator for a progressing cavity pump can comprise a housing include an inner housing surface defining an uninterrupted helical profile, and a liner including an inner liner surface and an outer liner surface. The inner liner surface and the outer liner surface can each define an uninterrupted helical profile, and the inner housing surface of the housing can be adapted to receive the outer liner surface to prevent lateral and rotational movement between the liner and the housing.

20 Claims, 7 Drawing Sheets

(56) References Cited

U.S. PATENT DOCUMENTS

| | | | | |
|---|---|---|---|---|
| 10,767,646 | B2 | 9/2020 | Tekneyan et al. | |
| 2009/0081050 | A1 | 3/2009 | Moore et al. | |
| 2009/0110579 | A1* | 4/2009 | Amburgey | F04C 2/1075 418/48 |
| 2010/0196182 | A1 | 8/2010 | Loeker et al. | |
| 2011/0020160 | A1 | 1/2011 | Wautelet et al. | |
| 2011/0123380 | A1 | 5/2011 | Thomas et al. | |
| 2012/0063941 | A1 | 3/2012 | Overmeier et al. | |
| 2014/0016991 | A1 | 1/2014 | Kamal et al. | |
| 2015/0010342 | A1 | 1/2015 | Groth et al. | |
| 2015/0086350 | A1 | 3/2015 | Kamal et al. | |
| 2015/0285245 | A1 | 10/2015 | Weber | |
| 2016/0084085 | A1 | 3/2016 | Eisner | |
| 2016/0341197 | A1 | 11/2016 | Tanaka | |
| 2018/0372092 | A1 | 12/2018 | Rothschild et al. | |
| 2019/0162183 | A1 | 5/2019 | Krampe | |
| 2019/0257308 | A1 | 8/2019 | Overmeier | |
| 2019/0316583 | A1 | 10/2019 | Dicks et al. | |
| 2020/0056609 | A1 | 2/2020 | Hauck et al. | |
| 2020/0284262 | A1 | 9/2020 | Coghlan | |
| 2021/0140428 | A1 | 5/2021 | Dicks et al. | |

FOREIGN PATENT DOCUMENTS

| | | | | |
|---|---|---|---|---|
| AU | 2015311228 | B2 | 6/2019 | |
| AU | 2017358848 | B2 | 1/2022 | |
| BR | PI0815403 | A2 | 2/2015 | |
| CA | 2264361 | A1 | 9/1999 | |
| CA | 2167545 | C | 10/2000 | |
| CA | 2609025 | A1 | 4/2009 | |
| CA | 2609110 | A1 | 4/2009 | |
| CA | 2959443 | A1 | 3/2016 | |
| CN | 1162622 | C | 8/2004 | |
| CN | 101796301 | B | 5/2013 | |
| CN | 102400909 | B | 3/2016 | |
| CN | 106605067 | B | 11/2018 | |
| CN | 106605066 | B | 6/2019 | |
| CN | 109952436 | B | 3/2021 | |
| CN | 109952435 | B | 4/2021 | |
| CN | 110271866 | B | 6/2021 | |
| DE | 0935072 | A1 * | 8/1990 | F04C 2/1075 |
| DE | 8817238 | U1 | 1/1995 | |
| DE | 19501441 | C1 | 4/1996 | |
| DE | 59520850 | U1 | 4/1996 | |
| DE | 3833515 | C2 | 7/1996 | |
| DE | 29812846 | U1 | 10/1998 | |
| DE | 19813999 | C1 | 11/1999 | |
| DE | 20011301 | U1 | 10/2000 | |
| DE | 19842754 | C2 | 4/2001 | |
| DE | 10118071 | C2 | 5/2003 | |
| DE | 10116641 | C2 | 7/2003 | |
| DE | 202005008989 | U1 | 8/2005 | |
| DE | 102006058166 | A1 | 6/2008 | |
| DE | 102008021920 | A1 | 2/2009 | |
| DE | 102008021919 | A1 | 11/2009 | |
| DE | 202013004219 | U1 * | 7/2013 | F01C 1/101 |
| DE | 102010037440 | B4 | 11/2014 | |
| DE | 102014116327 | A1 | 5/2016 | |
| DE | 102014112550 | B4 | 6/2016 | |
| DE | 102014112552 | B4 | 6/2016 | |
| DE | 202016008445 | U1 | 1/2018 | |
| DE | 202018101651 | U1 | 4/2018 | |
| DE | 102016121582 | A1 | 5/2018 | |
| DE | 102016121581 | B4 | 7/2018 | |
| DE | 102017100540 | B4 | 9/2018 | |
| DE | 102017104768 | A1 | 9/2018 | |
| DE | 102016117910 | B4 | 10/2018 | |
| DE | 102017007507 | A1 | 2/2019 | |
| DE | 102017126002 | B3 | 2/2019 | |
| DE | 102018102640 | A1 | 8/2019 | |
| DE | 10201810228 | A1 | 9/2019 | |
| DE | 102018110917 | A1 | 11/2019 | |
| DE | 102018113347 | A1 | 12/2019 | |
| DE | 1020181173741 | A1 | 1/2020 | |
| DE | 10201910767 | B3 | 7/2020 | |
| DE | 102019005366 | A1 | 2/2021 | |
| DE | 102019005367 | A1 | 2/2021 | |
| DE | 102019123180 | A1 | 3/2021 | |
| DE | 202019107043 | U1 | 3/2021 | |
| DE | 102019107078 | B4 | 4/2021 | |
| DE | 102019126675 | A1 | 4/2021 | |
| DE | 102019130981 | A1 | 5/2021 | |
| DE | 102019135635 | A1 | 6/2021 | |
| EP | 0723081 | B1 | 2/1999 | |
| EP | 0947700 | B1 | 1/2004 | |
| EP | 1739307 | A2 | 1/2007 | |
| EP | 2205872 | A2 | 7/2010 | |
| EP | 2176552 | B1 | 5/2012 | |
| EP | 2610493 | | 7/2013 | |
| EP | 3096014 | A1 | 11/2016 | |
| EP | 2428680 | B1 | 7/2017 | |
| EP | 3189235 | B1 | 2/2019 | |
| EP | 3189237 | b1 | 7/2019 | |
| EP | 3538766 | a1 | 9/2019 | |
| EP | 3538767 | A1 | 9/2019 | |
| EP | 3539911 | A1 | 9/2019 | |
| EP | 3538766 | b1 | 7/2020 | |
| EP | 3749861 | A1 | 12/2020 | |
| EP | 3803122 | A1 | 4/2021 | |
| EP | 3824162 | A1 | 5/2021 | |
| FR | 2823536B12 | | 10/2005 | |
| FR | 3023327 | A1 | 1/2016 | |
| GB | 2377255 | B | 8/2004 | |
| GB | 2556425 | B | 3/2021 | |
| HK | 114457 | A1 | 2/2011 | |
| JP | H08319939 | A | 12/1996 | |
| JP | H11311187 | A | 11/1999 | |
| JP | 5917216 | B2 | 4/2016 | |
| JP | 2019156642 | A | 9/2019 | |
| JP | 6660942 | B2 | 2/2020 | |
| KR | 102190348 | B1 | 12/2020 | |
| WO | WO-0129423 | A1 * | 4/2001 | F04C 2/1075 |
| WO | 2009024279 | | 2/2009 | |
| WO | 2010537095 | A | 12/2010 | |
| WO | WO-2011146245 | A1 | 11/2011 | |
| WO | WO-2012090968 | A1 * | 7/2012 | F04C 2/1075 |
| WO | WO-2014111082 | A1 | 7/2014 | |
| WO | WO-2014150917 | A1 | 9/2014 | |
| WO | WO-2016034340 | A1 | 3/2016 | |
| WO | WO-2016034341 | A1 | 3/2016 | |
| WO | WO-2016198036 | A1 | 12/2016 | |
| WO | WO-2018019318 | A1 | 2/2018 | |
| WO | WO-2018084254 | A1 | 5/2018 | |
| WO | WO-2018087248 | A1 | 5/2018 | |
| WO | WO-201830436 | A1 | 7/2018 | |
| WO | 2018162360 | | 9/2018 | |
| WO | wo-2019091701 | a1 | 5/2019 | |
| WO | wo-2019154571 | a1 | 8/2019 | |
| WO | wo-2019233859 | a1 | 12/2019 | |
| WO | wo-2020015873 | a1 | 1/2020 | |
| WO | wo-2021037668 | a1 | 3/2021 | |
| WO | wo-20210194087 | a1 | 5/2021 | |
| WO | wo-2021121743 | a1 | 6/2021 | |

OTHER PUBLICATIONS

English copy of DE 202013004219 by PE2E Aug. 31, 2023.*
English translation of EP0935072 by PE2E Mar. 25, 2024.*
English translaiton of WO2012090968 by PE2E Mar. 25, 2024.*
English translation of WO 0219423 by PE2E, Jun. 12, 2024.*
"U.S. Appl. No. 18/324,645, Non Final Office Action mailed Apr. 2, 2024", 16 pgs.
"U.S. Appl. No. 18/324,645, Response filed Jun. 19, 24 to Non Final Office Action mailed Apr. 2, 2024", 13 pgs.
"U.S. Appl. No. 18/680,394, Preliminary Amendment Filed Jun. 5, 2024", 5 pgs.
"Improved Productivity SCT Smart Conveying Technology", [Online]. Retrieved from the Internet: < URL: https://www.seepex.com/en-US/products/pumps/sct-smart-conveying-technology>, (accessed on Mar. 22, 2024), 17 pgs.

(56) References Cited

OTHER PUBLICATIONS

"Maintenance Manual", Leaflet 8101, (Apr. 1985), 1 pg.
"MSPC-1"-20MM-F, [Online]. Retrieved from the Internet: < URL: https://www.ruland.com/mspc-1-20mm-f.html>, (Accessed on Mar. 15, 2024), 5 pgs.
"Pulp and Paper Making Hollow Rotor of Progressing Cavity Pump", [Online]. Retrieved from the Internet: < URL: https://hbronice.en.made-in-china.com/product/yOIAeUuCCGqx/China-Pulp-and-Paper-Making-Hollow-Rotor-of-Progressing-Cavity-Pump.html>, (accessed on Mar. 15, 2024), 11 pgs.
"Seal", (1983), 1 pg.
"Standard Gland Backplate Mech Seals to DIN 24960", (1983), 1 pg.
"International Application Serial No. PCT US2024 030486, International Search Report mailed Sep. 4, 2024", 4 pgs.
"International Application Serial No. PCT US2024 030486, Written Opinion mailed Sep. 4, 2024", 5 pgs.

* cited by examiner

FREE-MOLD STATOR FOR A PROGRESSING CAVITY PUMP

TECHNICAL FIELD

The present application pertains generally, but not by way of limitation, to progressing cavity pumps. More particularly, the present disclosure pertains to systems and methods for inhibiting relative rotation between stator housings and stator liners.

BACKGROUND

Moineau-type progressing cavity pumps are presently in widespread use in various different applications across a variety of industries. For example, progressing cavity pumps are often used for pumping fluids in Net Positive Suction Head (NPSH) conditions, such as when lifting fluids from subterranean reservoirs, or for pumping highly viscous fluids, highly abrasive fluids, and fluids containing relatively large particulates or solid masses. Progressing cavity pumps include a stationary component known as a stator and a rotatable component known as a rotor. The stator generally includes a liner received within a casing or outer housing. The liner defines an inner profile forming a plurality of stator lobes and the rotor defines an outer profile forming a plurality of rotor lobes corresponding in shape and size to the plurality of stator lobes.

During rotation of the rotor within the stator, the rotor lobes engage and seal against the stator lobes to form a plurality of progressing cavities which travel through the stator in a linear fashion. However, a rotor applies significant dynamic radial loads to the liner during rotation, causing progressive erosion of the liner over time and reducing the efficiency and power output (e.g., available output torque or maximum rotor speed) of the progressing cavity pump. Eventually, the liner will deteriorate to a point rendering the progressing cavity pump inoperable. In many progressing cavity pumps, this can necessitate costly replacement of the entire stator. For example, such liners are generally permanently affixed to the casing or outer housing of the stator through chemical bonding or vulcanizing.

SUMMARY

The following presents a simplified summary of one or more embodiments of the present disclosure in order to provide a basic understanding of such embodiments. This summary is not an extensive overview of all contemplated embodiments; and is intended to neither identify key or critical elements of all embodiments, nor delineate the scope of any or all embodiments.

In one or more embodiments, a free-mold stator for a progressing cavity pump can include a housing including an inner housing surface defining an uninterrupted helical profile, and a liner including an inner liner surface and an outer liner surface. The inner liner surface and the outer liner surface can each define an uninterrupted helical profile, and the inner housing surface can be adapted to receive the outer liner surface to prevent rotational movement between the liner and the housing.

In one or more embodiments, a free-mold stator for a progressing cavity pump can include a housing including an inner housing surface defining an uninterrupted helical profile, and a liner including an inner liner surface and an outer liner surface. The inner liner surface can define an uninterrupted helical profile and the outer liner surface can define a substantially uninterrupted helical profile. The liner can also include an anchor portion extending radially outward from the outer liner surface, the anchor portion adapted to prevent rotational movement between the liner and the housing.

While multiple embodiments are disclosed, still other examples of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure can help to address the above issues, among others, by providing a free-mold stator for a progressing cavity pump. The free-mold stator can include a liner having an outer liner surface and an inner liner surface each defining a helical profile, and a housing having an inner housing surface defining an uninterrupted helical profile sized and shaped to receive the outer liner surface. The helical nature of the inner liner surface and the outer liner surface can enable the liner to define an even thickness of material there between, such as along a longitudinal length of the liner. When the liner is received within the housing, the helical nature of the outer liner surface and the inner housing surface can serve to mechanically anchor the housing to the liner. For example, in the operation of a progressing cavity pump including the free-mold stator, the outer liner surface can engage the inner housing surface to resist the torsional forces applied to the liner during rotation of a rotor therein, and thereby prevent rotation of the liner within the housing without the use of chemical bonding, vulcanizing, or permanent fixation techniques.

In view of the above, the free-mold stator of the present disclosure can enable the housing or outer casing of a stator having a liner made from an even or continuous thickness material to be re-used, which can help to reduce the long-term operating costs of many progressing cavity pumps, and make the replacement of the liner much more straight forward. Moreover, relative to many progressing cavity pumps including a stator liner having an uneven or varying thickness along a longitudinal length thereof, the even or continuous thickness of the liner of the free-mold stator can help to reduce deformation of stator lobes under force, which can improve the overall power output or the power density of many progressing cavity pumps.

Figure 1:
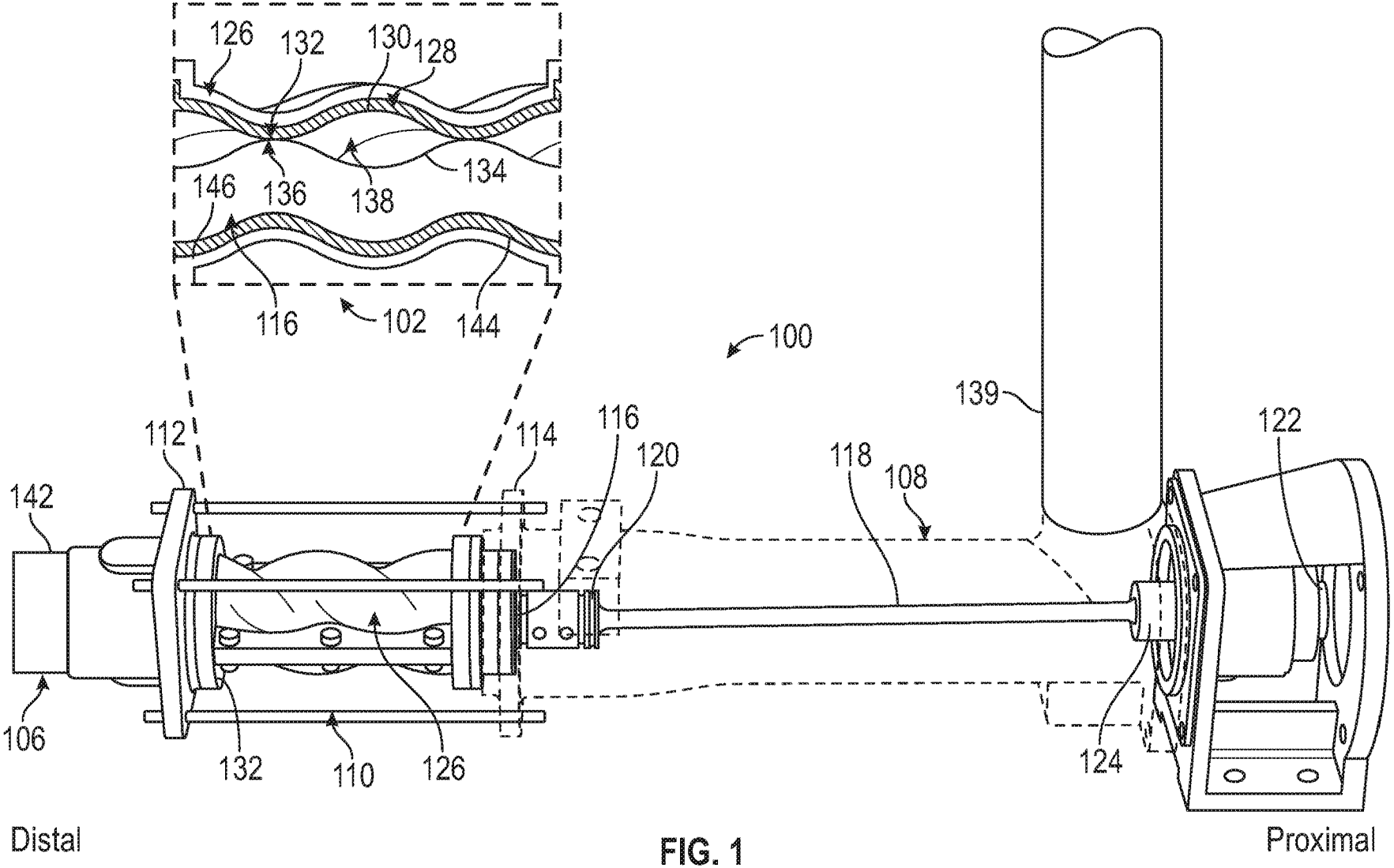
FIG. 1 illustrates isometric view of an example progressing cavity pump including a free-mold stator, in accordance with one or more embodiments of the present disclosure.

FIG. 1 illustrates an isometric view of an example progressing cavity pump 100 including a free-mold stator 102, in accordance with one or more embodiments of the present disclosure. Also shown in FIG. 1 are orientation indicators "Proximal" and "Distal". The progressing cavity pump 100 can include a free-mold stator 102, a pressure fitting 106, and an intake casing 108. In FIG. 1, the intake casing 108 is shown in shadow. The free-mold stator 102 can be compressively clamped between the pressure fitting 106 and the intake casing 108. In one example, the progressing cavity pump 100 can include a plurality of tie rods 110 extending through a distal flange 112 defined by the pressure fitting 106, and a proximal flange 114 defined by the intake casing 108 to bias the pressure fitting 106 toward the free-mold stator 102 and the intake casing 108.

The progressing cavity pump 100 can include a rotor 116 and a driveshaft 118. The rotor 116 can extend within the free-mold stator 102 and the driveshaft can extend within the intake casing 108. In some examples, the driveshaft 118 can extend between a first joint 120, such as connected to a shaft input connector 122, and a second joint 124, such as connected to the rotor 116. In such examples, the shaft input connector 122 can be adapted to receive a shaft of a motor to provide rotational drive to the rotor 116. The free-mold stator 102 can include a housing 126 and a liner 128. The housing 126 can be an outer shell or casing of the free-mold stator 102. The liner 128 can include an inner liner surface 130 defining a plurality of internal lobes 132. The rotor 116 can include an outer surface 134 defining a plurality of external lobes 136. The plurality of external lobes 136 can be sized and shaped to form a plurality of progressing cavities 138 via contact with the plurality of internal lobes 132.

During rotation of the rotor 116, the plurality of progressing cavities 138 can cause fluid to be drawn into the intake casing 108, such as through an inlet pipe 139 coupled thereto, and move distally through the free-mold stator 102 to an outlet pipe 142 coupled to the pressure fitting 106. The liner 128 can include an outer liner surface 144, and the housing 126 can include an inner housing surface 146. The outer liner surface 144 and the inner housing surface 146 can each define an uninterrupted helical profile; and the inner housing surface 146 can be sized and shaped to receive the outer liner surface 144, such as to enable the liner 128 to be freely arranged, or otherwise received, within the housing 126. For example, the outer liner surface 144 and the inner housing surface 146 can be in continuous contact along a longitudinal length of the free-mold stator 102 due to having the same or a similar surface profile. The helical nature of surface engagement between the inner liner surface 130 and the outer liner surface 144 can function to mechanically anchor the outer liner surface 144 to the inner housing surface 146, such as to prevent the torsional forces generated during rotation of the rotor 116 from causing the liner 128 to rotate within the housing 126.

Figure 2:
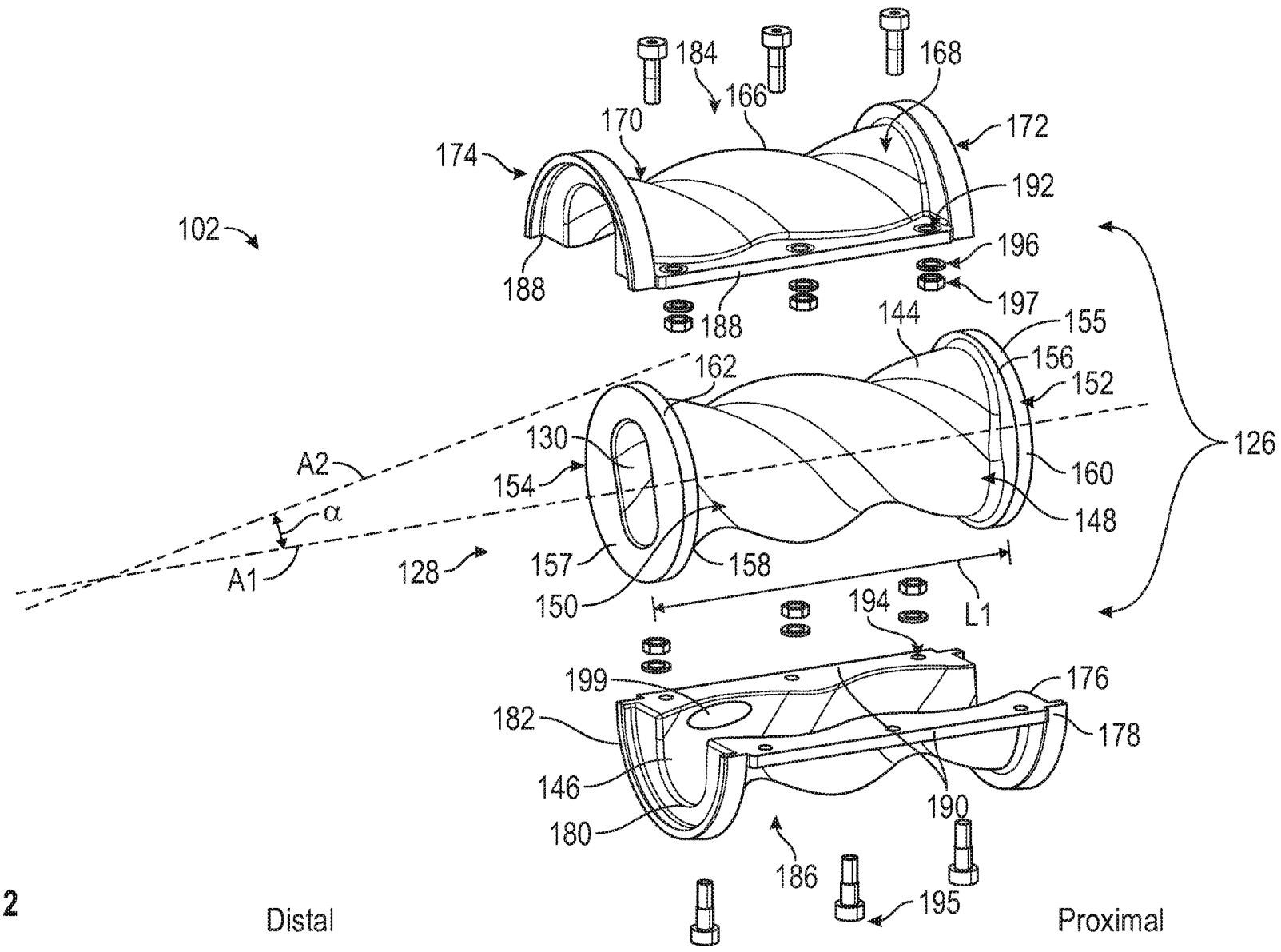
FIG. 2 illustrates an exploded view of the free-mold stator of FIG. 1, in accordance with one or more embodiments of the present disclosure.

FIG. 2 illustrates an exploded view of the free-mold stator 102 of FIG. 1, in accordance with one or more embodiments of the present disclosure. Also shown in FIG. 2 is a first axis A1, a second axis A2, and orientation indicators "Proximal" and "Distal". The first axis A1 can be a central axis A1 of the liner 128. The liner 128 can include a first liner end 148 and a second liner end 150. The first liner end 148 and the second liner end 150 can be opposite portions or segments of the liner 128. The liner 128 can define a longitudinal length L1. The longitudinal length L1 can be a lateral distance between the first liner end 148 and the second liner end 150, such as measured along the first axis A1.

In some examples, such as shown in FIG. 2, the first liner end 148 can include a first flange 152 and the second liner end 150 can include a second flange 154. The first flange 152, and the second flange 154, can be an annular ridge or projection extending radially outward beyond the outer liner surface 144.

The first flange 152 can define a first face 155 and a second face 156. The second flange 154 can define a third face 157 and a fourth face 158. The first face 155 can be a proximal-most surface of the first flange 152, and the third face 157 can be distal-most surface of the second flange 154. The second face 156 can extend parallel to, and can be distally offset from, the first face 155; and the fourth face 158 can extend parallel to, and can be proximally offset from, the third face 157. The first face 155, the second face 156, the third face 157, and the fourth face 158 can extend orthogonally to the first axis A1. The first flange 152 can define a first cam surface 160 and the second flange 154 can define a second cam surface 162. The first cam surface 160 can be an outer-most surface of the first flange 152, such as extending laterally between the first face 155 and the second face 156; and the second cam surface 162 can be an outer-most surface of the second flange 154, such as extending laterally between the third face 157 and the fourth face 158.

The first cam surface 160, and the second cam surface 162, can be a chamfered or angled surface, such as forming a frustoconical or inwardly tapered shape. The first cam surface 160 can define the second axis A2. The first cam surface 160 can extend at various angles relative to the first axis A1. For example, an angle $\alpha$ can represent the angle formed at the intersection of the first axis A1 and the second axis A2. The angle $\alpha$ can be, but is not limited to, between about 5 degrees to about to 50 degrees. In one example, such as shown in FIG. 2, the angle $\alpha$ can be about 15 degrees. While the angle $\alpha$ is described above with reference to the first cam surface 160. The second cam surface 162 can extend at similar, or identical, angles relative to the first cam surface 160 and the first axis A1.

The housing 126 can define an outer housing surface 166. In some examples, the outer housing surface 166 can define an uninterrupted, or substantially uninterrupted, helical profile. For example, the outer housing surface 166 can be similar in size and shape to the uninterrupted helical profile defined by the inner housing surface 146. This can enable the housing 126 to define an even thickness along at least a portion of its longitudinal length, such as to help reduce the amount of material used to produce the housing 126. The housing 126 can include a first housing end 168 and a second housing end 170. The first housing end 168 and the second housing end 170 can be opposite portions or segments of the housing 126. The first housing end 168 can include a first extension 172 and the second housing end 170 can include a second extension 174. The first extension 172, and the second extension 174, can be a formation or protrusion extending radially outward beyond the outer housing surface 166.

The first extension 172 can define a first housing end surface 176 and a first projection 178. The second extension 174 can define a second housing end surface 180 and a second projection 182. The first housing end surface 176, and the second housing end surface 180, can be an annular surface extending radially outward from the outer housing surface 166. The first housing end surface 176 and the second housing end surface 180 can extend orthogonally to the first axis A1. The first projection 178 can be an annular surface extending laterally outward, in a proximal direction, from the first housing end surface 176, and the second projection 182 can be an annular surface extending laterally outward, in a distal direction, from the second housing end surface 180.

The first projection 178 and the second projection 182 can extend parallel to the first axis A1. The first extension 172 can be adapted to support the first flange 152, and the second extension 174 can be adapted to support the second flange 154. For example, when the liner 128 is freely-arranged, or received, within the housing 126, the first housing end surface 176 can contact and engage the second face 156, and the second housing end surface 180 can contact and engage the fourth face 158. The first extension 172 can thereby brace the first flange 152 against lateral forces acting in a distal direction, and the second extension 174 can thereby brace and support the second flange 154 against lateral forces acting in a proximal direction.

In one example, such as shown in FIG. 2, the housing 126 can include a first portion 184 and a second portion 186. The first portion 184, and the second portion 186, can be a radial section of the housing 126. The first portion 184 and the second portion 186 can collectively form the housing 126. For example, the first portion 184 and the second portion 186 can each define a 180 degree section of the inner housing surface 146 and the outer housing surface 166. In other examples, the housing 126 can include other numbers of radial sections, such as, but not limited to, three, four, or five radial sections, such as each defining a 120 degree, 90 degree, or 72 degree sections, respectively, of the inner housing surface 146. In a further example, the housing 126 can be of unitary construction.

The first portion 184 can include a first pair of coupling flanges 188 and the second portion 186 can include a second pair of coupling flanges 190. The first pair of coupling flanges 188 can define a first plurality of bores 192 and the second pair of coupling flanges 190 can define a second plurality of bores 194. In one such an example, such as shown in FIG. 2, the free-mold stator 102 can include a plurality of fasteners 195, a plurality of washers 196, and a plurality of nuts 197 adapted to threadedly engage the plurality of fasteners 195. In another example, the first plurality of bores 192 or the second plurality of bores 194 can define a plurality of threads adapted to threadedly engage the plurality of fasteners 195.

The first plurality of bores 192 and the second plurality of bores 194 can be adapted to concurrently receive the plurality of fasteners 195 there through. For example, the first plurality of bores 192 can formed in corresponding positions relative to the second plurality of bores 194, such as to enable each bore of the first plurality of bores 192 and each bore of the second plurality of bores 194 to be aligned when the first pair of coupling flanges 188 is positioned on the second pair of coupling flanges 190. The first plurality of bores 192 and the second plurality of bores 194 can be defined in the first pair of coupling flanges 188 and the second pair of coupling flanges 190, respectively, in linear arrangement.

The first plurality of bores 192 and the second plurality of bores 194 can include various numbers of individual bores. In one example, such as shown in FIG. 2, the first plurality of bores 192 and the second plurality of bores 194 can each include six bores. In other examples, the first plurality of bores 192 and the second plurality of bores 194 can each include, for example, but not limited to, two, four, eight, or ten individual bores. The plurality of fasteners 195, the plurality of washers 196, and the plurality of nuts 197 can each include a number of fasteners, washers, and nuts, respectively, that is proportional to the number of bores defined by the first plurality of bores 192 and the number of bores defined by the second plurality of bores 194. In view of the above, the longitudinally split, or otherwise modular, nature of the housing 126 can help to facilitate rapid and convenient removal, and replacement, of the liner 128.

In some examples, the inner housing surface 146 can define a friction inducing texture 199. The friction inducing texture 199 can be a three-dimensional pattern adapted to frictionally engage the outer liner surface 144 when the liner 128 is received within the housing 126. For example, the friction inducing texture 199 can define a plurality of ridges, grooves, or other protrusions adapted to contact and engage the outer liner surface 144 to help prevent rotation of the liner 128 within the housing 126, such as during rotation of the rotor 116 (FIG. 1). The friction inducing texture 199 can cover an entire surface area, or one or more portions, of the inner housing surface 146.

Figure 3:
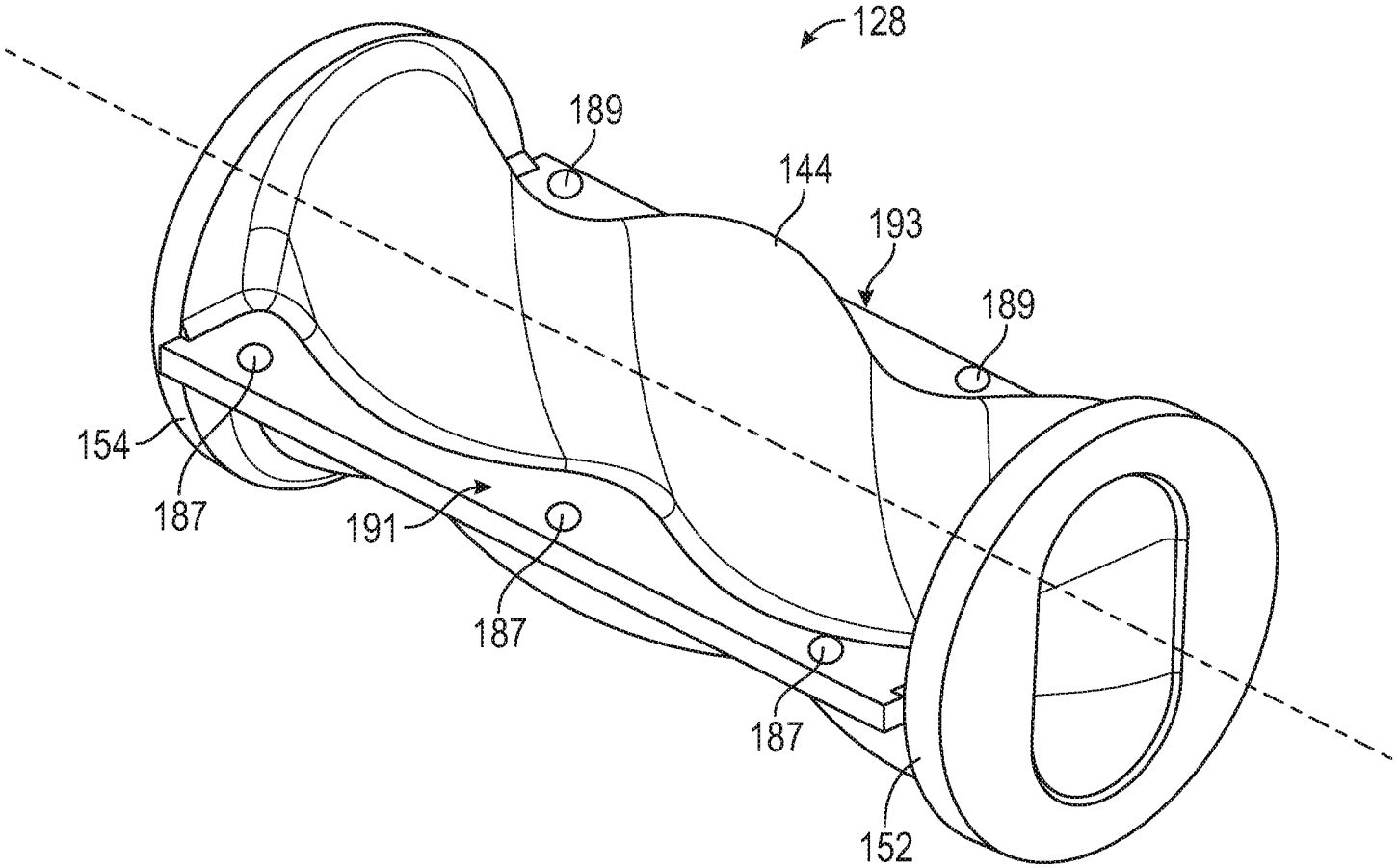
FIG. 3 illustrates an isometric view of a liner usable with the free-mold stator of FIG. 1, in accordance with one or more embodiments of the present disclosure.

FIG. 3 illustrates an isometric view of a liner 128 usable with the free-mold stator of FIG. 1, in accordance with one or more embodiments of the present disclosure. Also shown in FIG. 3 is a first axis A1. In some examples, the outer liner surface 144 can define a substantially uninterrupted helical profile. For example, the liner 128 can include an anchor portion adapted to help prevent rotation between the housing 126 and the liner 128. In one example, such an anchor portion can be realized in the form of a first pad 191 and a second pad 193, such as shown in FIG. 3. The first pad 191 and the second pad 193 can generally be planar projections or protrusions extending radially outward beyond the outer liner surface 144, such as orthogonally to the first axis A1. The first pad 191 and the second pad 193 can each form various three-dimensional shapes, such as including, but not limited to, a rectangular prism.

The first pad 191 and the second pad 193 can extend longitudinally along the liner 128 by various distances, such as, but not limited to, partially or entirely along the longitudinal length L1 (FIG. 2) defined between the first liner end 148 and the second liner end 150. In one example, such as shown in FIG. 3, the first pad 191 and the second pad 193 can extend parallel to, and laterally offset from, the first axis A1 and along the outer liner surface 144 between the first flange 152 and the second flange 154. In some examples, such as when the liner 128 used with the housing 126 shown in, and described with regard to FIGS. 1-2, the first pad 191 can define a first plurality of apertures 187 and the second pad 193 can define a second plurality of apertures 189.

The first plurality of apertures 187 and the second plurality of apertures 189 can each be adapted to, together with the first plurality of bores 192 and the second plurality of bores 194, concurrently receive the plurality of fasteners 195 (FIG. 2) there through. For example, each the first plurality of apertures 187 can be formed in a corresponding position to an individual bore of the first plurality of bores 192 (FIG. 2) extending through the first pair of coupling flanges 188 (FIG. 2) and each of the second plurality of apertures 189 can be formed in a corresponding position to an individual bore of the second plurality of bores 194 (FIG. 2) extending through the second pair of coupling flanges 190 (FIG. 2). This can enable the first pad 191 and the second pad 193 to be secured, and compressively clamped, between the first pair of coupling flanges 188 and the second pair of coupling flanges 190 when the first portion 184 of the housing 126 is secured to the second portion 186 of the housing 126.

Figure 4:
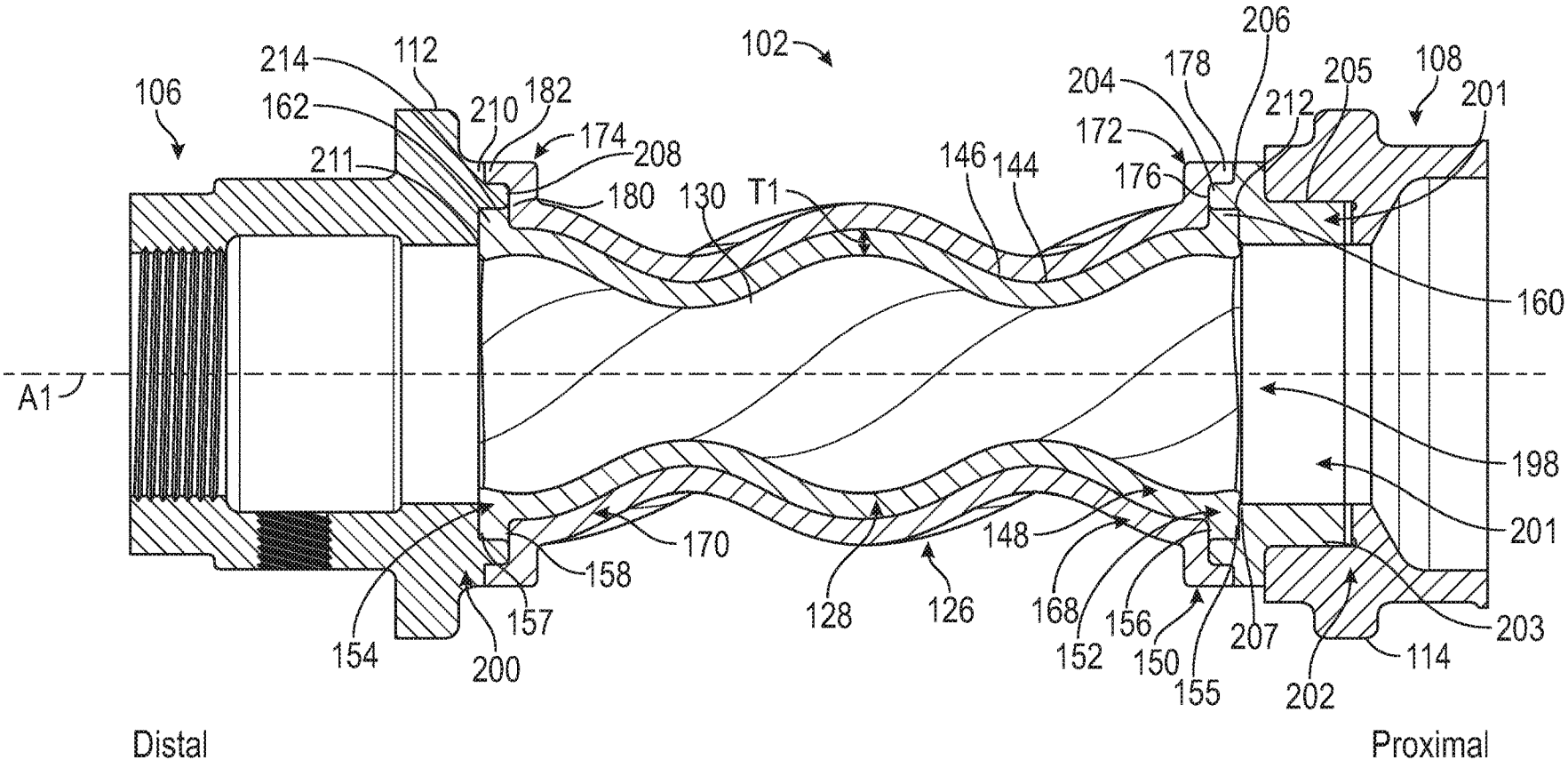
FIG. 4 illustrates a cross-section of the free-mold stator of FIG. 1 compressively clamped between a pressure fitting and an intake casing, in accordance with one or more embodiments of the present disclosure.

FIG. 4 illustrates a cross-section of the free-mold stator 102 of FIG. 1 compressively clamped between a pressure fitting 106 and an intake casing 108, in accordance with one or more embodiments of the present disclosure. Also shown in FIG. 3 is a first axis A1, and orientation indicators "Proximal" and "Distal". The liner 128 can define a thickness T1 (FIG. 3). The thickness T1 can be defined as a vertical distance between the inner liner surface 130 and the outer liner surface 144, such as measured orthogonally to the first axis A1. In some examples, the thickness T1 can be completely, or entirely, even between the first flange 152 and the second flange 154, or even throughout the longitudinal length L1 (FIG. 2) defined between the first liner end 148 and the second liner end 150. For example, the outer liner surface 144 can define an uninterrupted helical profile similar in size and shape to the uninterrupted helical profile defined by the inner liner surface 130.

In other examples, the thickness T1 can be substantially even between the first flange 152 and the second flange 154, or even throughout the longitudinal length L1 (FIG. 2) defined between the first liner end 148 and the second liner end 150. For example, the outer liner surface 144 can define a substantially uninterrupted helical profile that is similar in size and shape to the uninterrupted helical profile defined by the inner liner surface 130, except in that the outer liner surface 144 can include the first pad 191 (FIG. 3), the second pad 193 (FIG. 3), or other protrusions or projections extending radially outward from the outer liner surface 144.

The progressing cavity pump 100 (FIG. 1) can include a first compression element 198, a second compression element 200, and a third compression element 202. The second compression element 200 can be a proximal end portion of the pressure fitting 106. For example, the second compression element 200 can be a portion of the pressure fitting 106 including the distal flange 112. The third compression element 202 can be a distal end portion of the intake casing 108. For example, the third compression element 202 can be a portion of the intake casing 108 including the proximal flange 114. The first compression element 198 can include an end portion 201 defining an outer annular surface 203 and the third compression element 202 can define an inner annular surface 205. The end portion 201 can be adapted to be received within the third compression element 202. For example, the outer annular surface 203 can be sized and shaped to slidingly engage the inner annular surface 205, such as to enable the third compression element 202 to circumferentially encompass and receive the end portion 201 of the first compression element 198.

The first compression element 198 can define a first end surface 204 and a first annular surface 206. The second compression element 200 can define a second end surface 208 and a second annular surface 210. The first end surface 204 can be a distal-most surface of the first compression element 198, and the second end surface 208 can be a proximal-most surface of the second compression element 200. The first annular surface 206 can extend parallel to, and can be proximally offset from, the first end surface 204. The second annular surface 210 can extend parallel to, and can be distally offset from, the second end surface 208. The first end surface 204, the first annular surface 206, the second end surface 208, and the second annular surface 210 can extend orthogonally to the first axis A1. The first compression element 198 can also define a third annular surface 207. The third annular surface 207 can be a surface of the first compression element 198 that is proximally offset from the first annular surface 206 and the first end surface 204.

The first extension 172 can be adapted to maintain the first housing end 168 in a position that is concentric, or is otherwise axially aligned with, the first axis A1; and the second extension 174 can be adapted to maintain the second housing end 170 in a position that is concentric, or is otherwise axially aligned with, the first axis A1. For example, the first projection 178 of the first extension 172 can contact the first annular surface 206 of the first compression element 198, and the first housing end surface 176 of the first extension 172 can contact the first end surface 204 of the first compression element 198. Similarly, the second projection 182 of the second extension 174 can contact the second annular surface 210 of the second compression element 200, and the second housing end surface 180 of the second extension 174 can contact the second end surface 208 of the second compression element 200. In view of the above, the first extension 172 and the first compression element 198, and the second extension 174 and the second compression element 200, can each form an overlapping arrangement which can ensure the housing 126 remains in a position that is concentric, or is otherwise axially aligned with, the pressure fitting 106, and the intake casing 108, and the first axis A1, during rotation of the rotor 116 (FIG. 1).

The first compression element 198 can help to prevent, such as in addition to the helical engagement between the inner housing surface 146 and the outer liner surface 144, lateral and rotational movement between the first liner end 148 and the first housing end 168. For example, when the first projection 178 of the first extension 172 is in contact with the first annular surface 206, and the first housing end surface 176 of the first extension 172 is in contact with the first end surface 204, the first face 155 of the first flange 152 can be engaged by the third annular surface 207 of the first compression element 198 to bias the first face 155 distally, and the second face 156 of the first flange 152 can be engaged by the first housing end surface 176 to bias the second face 156 proximally. The first flange 152 of the liner 128 can thereby be compressively clamped between the first extension 172 of the housing 126 and the first compression element 198 to help prevent the liner 128 from rotating, or translating axially within, the housing 126 during rotation of the rotor 116 (FIG. 1).

The second compression element 200 can help to prevent lateral and rotational movement between the second liner end 150 and the second housing end 170, such as in addition to the helical nature of the surface engagement between the inner housing surface 146 and the outer liner surface 144. For example, when the second projection 182 of the second extension 174 is in contact with the second annular surface 210, and the second housing end surface 180 of the second extension 174 is in contact with the second end surface 208, the third face 157 of the second flange 154 can be engaged by the fourth annular surface 211 of the second compression element 200 to bias the third face 157 proximally, and the fourth face 158 of the liner 128 can be engaged by second housing end surface 180 to bias the fourth face 158 distally. The second flange 154 of the liner 128 can thereby be compressively clamped between the second extension 174 of the housing 126 and the second compression element 200 to help prevent the liner 128 from rotating, or translating axially within, the housing 126 during rotation of the rotor 116 (FIG. 1).

The first compression element 198 can be adapted to limit compression of the first flange 152, and the second compression element 200 can be adapted to limit compression of the second flange 154. For example, a lateral distance, measured relative to the first axis A1, between the first end surface 204 of the first compression element 198 and the third annular surface 207 of the first compression element 198, and the second end surface 208 of the second compression element 200 and the fourth annular surface 211 of the second compression element 200, can dictate an amount of compression force or clamping prestress applied to the first flange 152 and the second flange 154, respectively, when the free-mold stator 102 is compressively clamped between the pressure fitting 106 and the intake casing 108.

The first compression element 198 can define a first tapered surface 212, and the second compression element 200 can define a second tapered surface 214. The first tapered surface 212 can be a surface extending laterally between the third annular surface 207 and the first end surface 204. The second tapered surface 214 can be a surface extending laterally between the fourth annular surface 211 and the second end surface 208. The first tapered surface 212 and the second tapered surface 214 can be chamfered or angled surfaces, such as forming an inverted frustoconical, or outwardly tapered, shape. The first tapered surface 212 and the second tapered surface 214 can extend parallel to the first cam surface 160 and the second cam surface 162. For example, if the angle $\alpha$ (FIG. 2) defined by the first cam surface 160 or the second cam surface 162 is 15 degrees, the first tapered surface 212 and the second tapered surface 214 can also extend at an angle of 15 degrees relative to the first axis A1.

The first cam surface 160 and the first tapered surface 212 can maintain the first liner end 148 in a position that is concentric, or is otherwise axially aligned with, the first axis A1; and the second cam surface 162 and the second tapered surface 214 can maintain the second liner end 150 in a position that is concentric, or is otherwise axially aligned with, the first axis A1. For example, when the first face 155 of the first flange 152 is translated proximally toward third annular surface 207 of the first compression element 198, such as during replacement of the free-mold stator 102, the first cam surface 160 can slidingly engage (e.g., slide along) the first tapered surface 212 to concentrically center the first liner end 148 within the first compression element 198. Similarly, when the fourth annular surface 211 of the second compression element is translated proximally toward the third face 157 of the second flange 154, such as during replacement of the free-mold stator 102, the second cam surface 162 can slidingly engage (e.g., slide along) the second tapered surface 214 to concentrically center the second liner end 150 within the second compression element 200.

The liner 128 can be made from a variety of different materials, such as, but not limited to, coated or uncoated polymeric or elastomeric materials such as, but not limited to, nitrile butadiene rubber (NBR), hydrogenated nitrile butadiene rubber (HNBR), styrene butadiene rubber (SBR), fluoroelastomer (FKM, FPM), perfluoroelastomer (FFKM), polypropylene (PP), polyurethane (PU), polyethylene (PE), or phenolic. The housing 126, or the housing 302 shown in, and described with regard to FIGS. 5-7, can also be made from a variety of different materials, such as including, but not limited to, hardened steel, stainless steel, metal alloys adapted for strength and/or corrosion resistance, or coated metals (e.g., nickel, epoxy, etc.).

In the operation of some examples, the liner 128 can be replaced by a user, such as when the plurality of internal lobes 132 (FIG. 1) have eroded to a point rendering the progressing cavity pump 100 inoperable, inefficient, or less efficient. The plurality of tie rods 110 (FIG. 1) can first be removed, and the pressure fitting 106 can be moved away from the intake casing 108, such as in a distal direction. The free-mold stator 102 can then be removed from the progressing cavity pump 100. Next, the liner 128 can be removed from the housing 126, such as by splitting the housing 126 into two or more separate portions or segments; and a replacement for the liner 128 can be positioned within the housing 126. The free-mold stator 102 can then be repositioned between the pressure fitting 106 and the intake casing 108. Finally, the plurality of tie rods 110 can be reinstalled to compressively clamp the free-mold stator 102 between the intake casing 108 and the pressure fitting 106.

Figure 5:
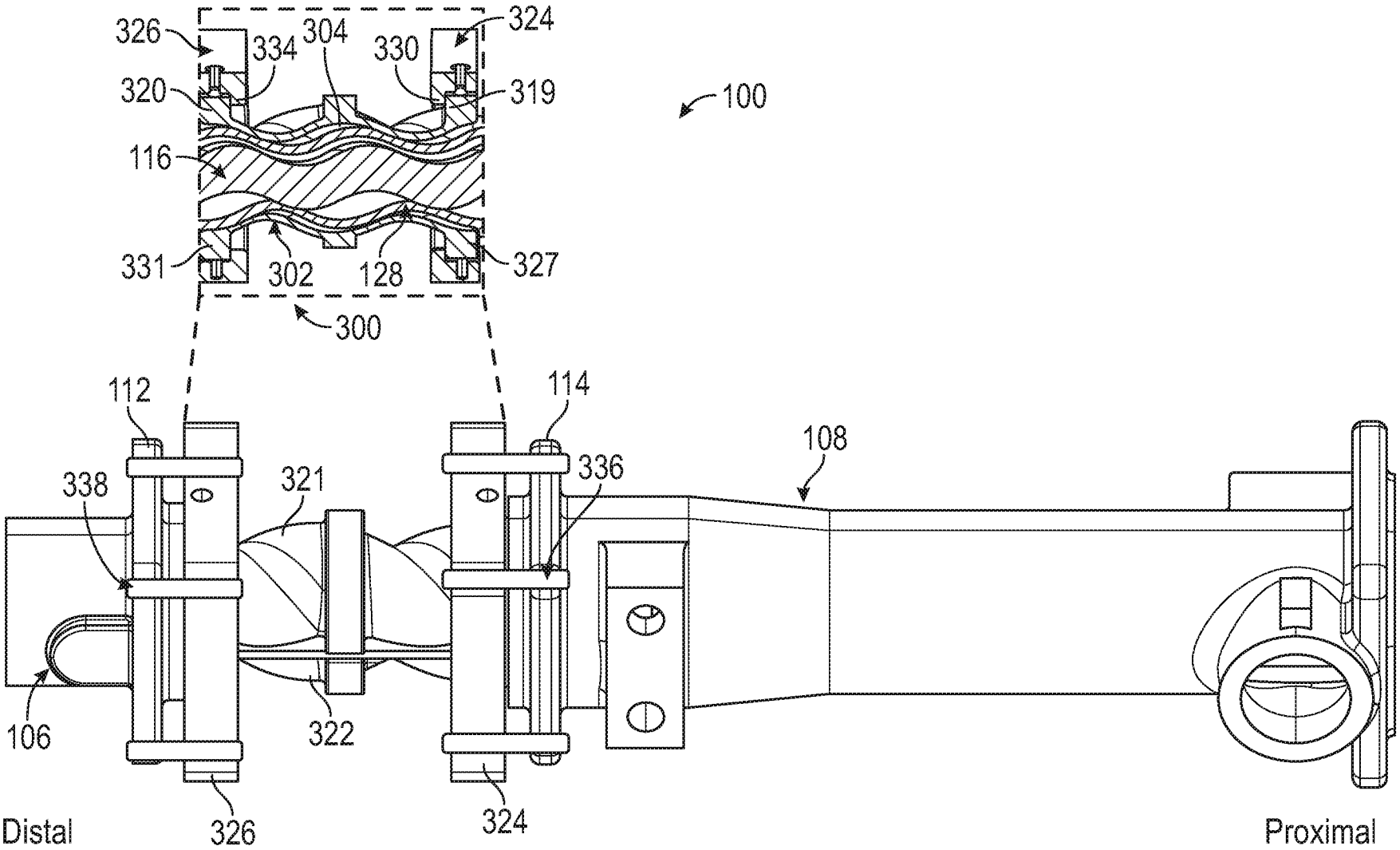
FIG. 5 illustrates an isometric view of an example progressing cavity pump including a free-mold stator, in accordance with one or more embodiments of the present disclosure.
Figure 6:
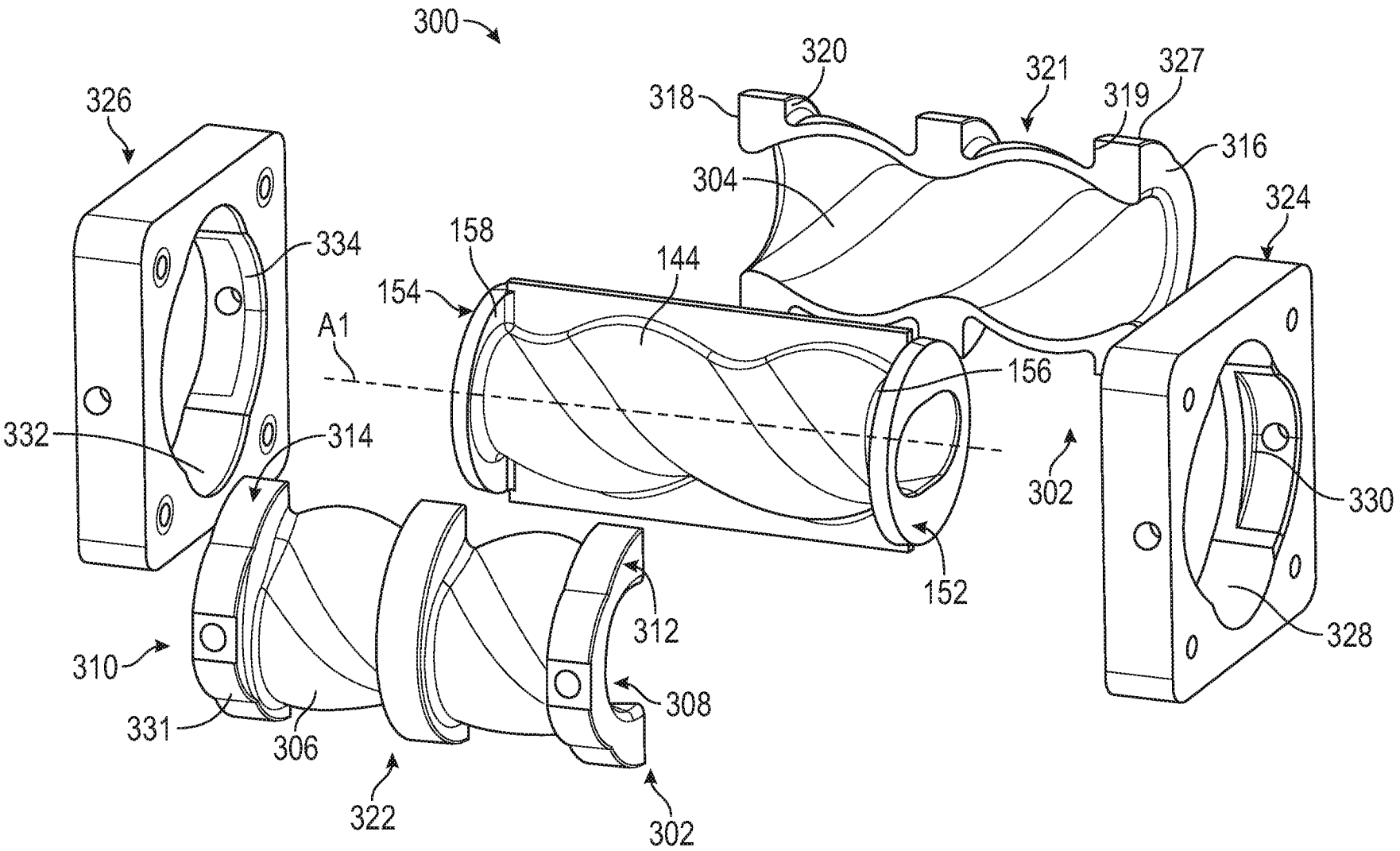
FIG. 6 illustrates an exploded view of the free-mold stator of FIG. 5, in accordance with one or more embodiments of the present disclosure.

FIG. 5 illustrates a perspective view of an example progressing cavity pump 100 including a free-mold stator 300, in accordance with one or more embodiments of the present disclosure. FIG. 6 illustrates an exploded view of the free-mold stator 300 of FIG. 4, in accordance with one or more embodiments of the present disclosure. Also shown in FIG. 6 are orientation indicators "Proximal" and "Distal", and a first axis A1. The free-mold stator 300 can include the liner 128 shown in, and described with regard to, any of FIGS. 1-4 above. The free-mold stator 300 can include a housing 302. The housing 302 can be similar to the housing 126 shown in, and described with regard to, any of FIGS. 1-4 above, at least in that the housing 302 can include an inner housing surface 304 defining an uninterrupted helical profile.

The inner housing surface 304 can be sized and shaped to receive the outer liner surface 144, such as to enable the liner 128 to be freely arranged, or otherwise positioned, within the housing 302. The housing 302 can include an outer housing surface 306. In some examples, the housing 302 can define an uninterrupted, or substantially uninterrupted, helical profile, such as similar to the outer housing surface 166 (FIG. 2). For example, the outer housing surface 306 can be similar in size and shape to the uninterrupted helical profile defined by the inner housing surface 304. This can enable the housing 302 to define an even thickness along at least a portion of its longitudinal length, such as to help reduce the amount of material used to produce the housing 302. The housing 302 can include a first housing end 308 (FIG. 6) and a second housing end 310 (FIG. 6). The first housing end 308 and the second housing end 310 can be opposite portions or segments of the housing 302.

The first housing end 308 can include a first extension 312 and the second housing end 310 can include a second extension 314. The first extension 312 and the second extension 314 can be formations or projections extending radially outward beyond the outer housing surface 306. The first extension 312 can define a first housing end surface 316 (FIG. 6) and a third housing end surface 319. The second extension 314 can define a second housing end surface 318 (FIG. 6) and a fourth housing end surface 320. The first housing end surface 316, the second housing end surface 318, the third housing end surface 319, and the fourth housing end surface 320 can be annular surfaces extending radially outward from the outer housing surface 306, such as orthogonally to the first axis A1.

The first extension 312 can be adapted to support the first flange 152, and the second extension 314 can be adapted to support the second flange 154. For example, when the liner 128 is received within the housing 302, the first housing end surface 316 can contact and engage the second face 156 (FIG. 6), and the second housing end surface 318 can contact and engage the fourth face 158 (FIG. 6). In view of the above, the first extension 312 can thereby brace and support the first flange 152 against lateral forces acting in a distal direction; and the second extension 314 can brace and support the second flange 154 against lateral forces acting in a proximal direction.

In one example, such as shown in FIGS. 5-6, the housing 126 can include a first portion 321 and a second portion 322. The first portion 321, and the second portion 322, can each be a radial section of the housing 126. The first portion 321 and the second portion 322 can collectively form the housing 126. For example, the first portion 321 and the second portion 322 can each define a 180 degree section of the inner housing surface 304 and the outer housing surface 306. In other examples, the housing 302 can include other numbers of radial sections, such as, but not limited to, three, four, or five radial sections, such as each defining 120 degree, 90 degree, or 72 degree sections, respectively, of the inner housing surface 304. In such examples, the liner 128 can include a third pad, a fourth pad, or a fifth pad, respectively, extending radially outward from the outer liner surface 144, such as in addition to the first pad 191 (FIG. 6) and the second pad 193 (FIG. 6). This can enable the liner 128 to include a pad, projection, or protrusion to be compressively clamped between, and thereby separate, each radial section collectively forming the housing 302. In a further example, the housing 302 can be of unitary construction.

The free-mold stator 300 can include a first clamping element 324 and a second clamping element 326. The first clamping element 324 can define a first inner surface 328 (FIG. 6) and a first end surface 330. The first clamping element 324 can be adapted to receive the first extension 312 of the housing 302. For example, the first inner surface 328 can be sized and shaped to conform to the size and shape of a first outer surface 327 (FIG. 6) of the first extension 312, such as to enable the first inner surface 328 to circumferentially contact and engage the first extension 312. The second clamping element 326 can define a second inner surface 332 (FIG. 6) and a second end surface 334. The second clamping element 326 can be adapted to receive the second extension 314 of the housing 302. For example, the second inner surface 332 can be sized and shaped to conform to the size and shape of a second outer surface 331 of the second extension 314, such as to enable the second inner surface 332 to circumferentially contact and engage the second extension 314. This can enable the first portion 321 of the housing 302 to be secured to the second portion 322 of the housing 302, and the first pad 191 and the second pad 193 to be compressively clamped there between, when the first extension 312 is received within the first clamping element 324 and the second extension 314 is received within the second clamping element 326.

The first clamping element 324 and the second clamping element 326 can enable the free-mold stator 102 to be compressively clamped between the pressure fitting 106 (FIG. 5) and the intake casing 108 (FIG. 5), such as without using the plurality of tie rods 110 (FIG. 0.1). For example, the first end surface 330 and the second end surface 334 can extend orthogonally to the first axis A1, and the progressing cavity pump 100 can include a plurality of first fasteners 336 extending through a distal flange 112 defined by the pressure fitting 106 and the first clamping element 324, and a plurality of second fasteners 338 extending through the proximal flange 114 defined by the intake casing 108 and the second clamping element 326, to bias the pressure fitting 106 toward the free-mold stator 102 and the intake casing 108.

The first clamping element 324 and the second clamping element 326 can maintain the first housing end 308 and the second housing end 310 in a position that is concentric, or is otherwise axially aligned with, the first axis A1. For example, the first outer surface 327 of the first extension 312 can contact the first inner surface 328 of the first clamping element 324 and the second outer surface 331 of the second extension 314 can contact the second inner surface 332 of the second clamping element 326. In view of the above, the first clamping element 324 and the first extension 312, and the second clamping element 326 and the second extension 314, can each form an overlapping arrangement which can ensure the housing 302 remains in a position that is concentric, or is otherwise axially aligned with, the pressure fitting 106 and the intake casing 108 during rotation of the rotor 116 (FIG. 1).

Figure 7:
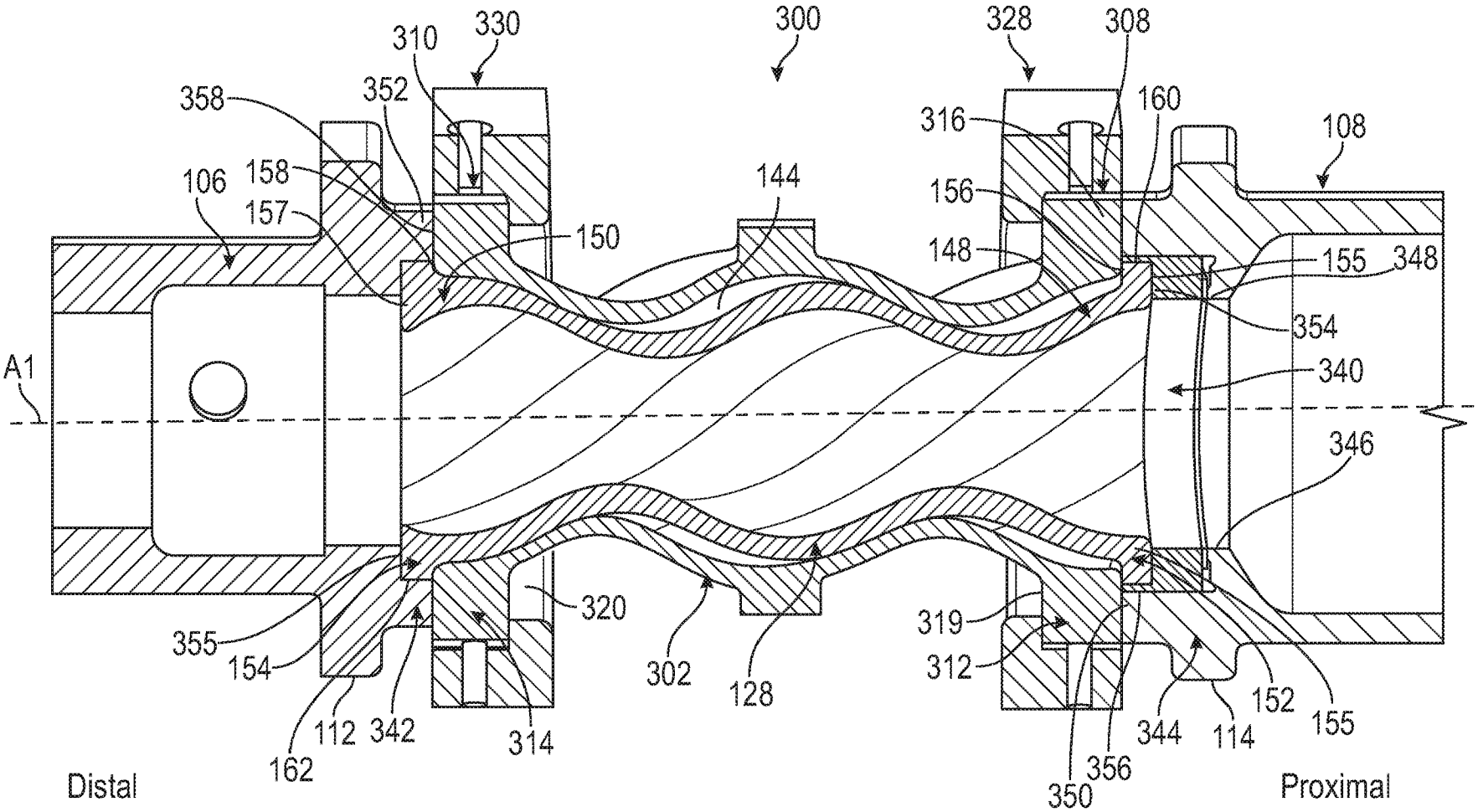
FIG. 7 illustrates a cross-section of the free-mold stator of FIGS. 5-6 compressively clamped between a pressure fitting and an intake casing, in accordance with one or more embodiments of the present disclosure.

FIG. 7 illustrates a cross-section of the free-mold stator of FIGS. 5-6 compressively clamped between a pressure fitting 106 and an intake casing 108, in accordance with one or more embodiments of the present disclosure. Also shown in FIG. 7 is a first axis A1, and orientation indicators "Proximal" and "Distal". The progressing cavity pump 100 (FIG. 1), such as when including the free-mold stator 300, can include a first compression element 340, a second compression element 342, and a third compression element 344. The second compression element 342 can be a proximal end portion of the pressure fitting 106. For example, the second compression element 342 can be a portion of the pressure fitting 106 including the distal flange 112. The third compression element 344 can be a distal end portion of the intake casing 108. For example, the third compression element 344 can be a portion of the intake casing 108 including the proximal flange 114. The first compression element 340 can generally be an annular spacer or adapter, such as configured to connect the third compression element 344 (e.g., the intake casing 108) to the housing 302 and the liner 128.

The first compression element 340 can define an outer annular surface 346 and the third compression element 344 can define an inner annular surface 348. The first compression element 340 can be adapted to be received within the third compression element 344. For example, the outer annular surface 346 can be sized and shaped to slidingly engage the inner annular surface 348, such as to enable the third compression element 344 to circumferentially encompass the first compression element 340. The third compression element 344 can define a first end surface 350 and the second compression element 342 can define a second end surface 352.

The first end surface 350 can be a distal-most surface of the first compression element 340, and the second end surface 352 can be a proximal-most surface of the second compression element 200. The first end surface 350 and the second end surface 352 can extend orthogonally to the first axis A1. The first compression element 340 can define a proximal surface 354. The proximal surface 354 can be an annular surface of the first compression element 340 that is proximally offset from the first end surface 350 when the first compression element 340 is received within the third compression element 344. The second compression element 342 can define a distal surface 355. The distal surface 355 can be an annular surface of the second compression element 342 that is distally offset from the second end surface 352.

The first compression element 340 and the first extension 312 can help to prevent lateral and rotational movement between the inner housing surface 304 and the outer liner surface 144, such as in addition to the helical nature of the surface engagement between the first liner end 148 and the first housing end 308. For example, when the first extension 312 is in contact with the first compression element 340, the first face 155 of the first flange 152 can be engaged by the proximal surface 354 to bias the first face 155 distally, and the second face 156 of the first flange 152 can be engaged by the first housing end surface 316 to bias the second face 156 proximally. The first flange 152 of the liner 128 can thereby be compressively clamped between the first extension 312 of the housing 302 and the first compression element 340 to help prevent the liner 128 from rotating, or translating axially within, the housing 302 during rotation of the rotor 116 (FIG. 5).

The second compression element 342 can also help to prevent lateral and rotational movement between the inner housing surface 304 and the outer liner surface 144, such as in addition to the helical nature of the surface engagement between the inner housing surface 304 and the outer liner surface 144. For example, when the second extension 314 is in contact with the second compression element 342, the third face 157 of the second flange 154 can be engaged by the distal surface 355 of the second compression element 342 to bias the third face 157 proximally, and the fourth face 158 of the liner 128 can be engaged by the second housing end surface 318 to bias the fourth face 158 distally. The first flange 152 of the liner 128 can thereby be compressively clamped between the second extension 314 of the housing 302 and the second compression element 342 to help prevent the liner 128 from rotating, or translating axially within, the housing 302 during rotation of the rotor 116 (FIG. 5).

The first compression element 340 can be adapted to limit compression of the first flange 152, and the second compression element 342 can be adapted to limit compression of the second flange 154. For example, a lateral distance, measured relative to the first axis A1, between the first end surface 350 of the first compression element 340 and the proximal surface 354 of the first compression element 340, and the second end surface 352 of the second compression element 342 and the distal surface 355 of the second compression element 342, can dictate an amount of compression force or clamping prestress applied to the first flange 152 and the second flange 154, respectively, when the free-mold stator 300 is compressively clamped between the pressure fitting 106 and the intake casing 108.

The first compression element 340 can define a first tapered surface 356, and the second compression element 342 can define a second tapered surface 358. The first tapered surface 356 can be a surface extending laterally between the proximal surface 354 and the first end surface 350. The second tapered surface 358 can be a surface extending laterally between the distal surface 355 and the second end surface 352. The first tapered surface 356 and the second tapered surface 358 can be chamfered or angled surfaces, such as forming an inverted frustoconical, or outwardly tapered, shape. The first tapered surface 356 and the second tapered surface 358 can extend parallel to the first cam surface 160 and the second cam surface 162. For example, if the angle $\alpha$ (FIG. 2) defined by the first cam surface 160 is 15 degrees, the first tapered surface 356 can also extend at an angle of 15 degrees relative to the first axis A1.

The first cam surface 160 and the first tapered surface 356 can maintain the first liner end 148 in a position that is concentric, or is otherwise axially aligned with, the first axis A1; and the second cam surface 162 and the second tapered surface 358 can maintain the second liner end 150 in a position that is concentric, or is otherwise axially aligned with, the first axis A1. For example, when the first face 155 of the first flange 152 is translated proximally toward the proximal surface 354 of the first compression element 198, such as during replacement of the free-mold stator 300, the first cam surface 160 can slidingly engage (e.g., slide along) the first tapered surface 356 to concentrically center the first liner end 148 within the first compression element 340. Similarly, the distal surface 355 of the second compression element 342 is translated proximally toward the third face 157 of the second flange 154, such as during replacement of the free-mold stator 300, the second cam surface 162 can slidingly engage (e.g., slide along) the second tapered surface 358 to concentrically center the second liner end 150 within the second compression element 342.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure.

This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

EXAMPLES

The following, non-limiting examples, detail certain aspects of the present subject matter to solve the challenges and provide the benefits discussed herein, among others.

Example 1 is a free-mold stator for a progressing cavity pump, the free-mold stator comprising: a housing including an inner housing surface defining an uninterrupted helical profile; and a liner including an inner liner surface and an outer liner surface, the inner liner surface and the outer liner surface each defining an uninterrupted helical profile, wherein the inner housing surface is adapted to receive the outer liner surface to prevent rotational movement between the liner and the housing.

In Example 2, the subject matter of Example 1 includes, wherein the liner includes: a first liner end and a second liner end; a longitudinal length defined between the first liner end and the second liner end; and a thickness defined between the outer liner surface and the inner liner surface, wherein the thickness is even throughout the longitudinal length.

In Example 3, the subject matter of Example 2 includes, wherein: the first liner end includes a first flange extending radially outward beyond the outer liner surface; and the second liner end includes a second flange extending radially outward beyond the outer liner surface.

In Example 4, the subject matter of Example 3 includes, wherein the housing includes: a first extension extending radially outward beyond an outer housing surface and in contact with the first flange, the first extension adapted to support the first flange; and a second extension extending radially outward beyond the outer housing surface and in contact with the second flange, the second extension adapted to support the second flange.

In Example 5, the subject matter of Example 4 includes, wherein the free-mold stator is positioned between a first compression element and a second compression element of a progressing cavity pump; and wherein: the first compression element is adapted to compress the first flange of the liner against the first extension of the housing to help prevent lateral and rotational movement between the liner and the housing, the first compression element including a first tapered surface; and the second compression element is adapted to compress the second flange of the liner against the second extension of the housing to help prevent lateral and rotational movement between the liner and the housing, the second compression element including a second tapered surface.

In Example 6, the subject matter of Example 5 includes, wherein: the first flange defines a first cam surface adapted to slidingly engage the first tapered surface of the first compression element when the first flange is compressed against the first extension of the housing by the first compression element; and the second flange defines a second cam surface adapted to slidingly engage the second tapered surface of the second compression element when the second flange is compressed against the second extension of the housing by the second compression element.

In Example 7, the subject matter of Example 6 includes, wherein: the first compression element defines a first end surface adapted to contact the first extension of the housing to limit compression of the first flange between the first compression element and the first extension; and the second compression element defines a second end surface adapted to contact the second extension of the housing to limit compression of the second flange between the second compression element and the second extension.

In Example 8, the subject matter of Examples 6-7 includes, wherein: the first extension of the housing includes a first projection extending toward the first liner end and the first compression element, the first projection adapted to contact a first annular surface defined by the first compression element; and the second extension of the housing includes a second projection extending toward the second liner end and the second compression element, the second projection adapted to contact a second annular surface defined by the second compression element.

In Example 9, the subject matter of Example 8 includes, wherein the first compression element a third compression element adapted to circumferentially encompass an end portion of the first compression element; and a plurality of tie rods extending longitudinally between the second compression element and the third compression element, the plurality of tie rods adapted to bias the second compression element toward the third compression element to cause: the first compression element to compress the first flange against the first extension; and the second compression element to compress the second flange against the second extension.

In Example 10, the subject matter of Examples 1-9 includes, wherein the housing includes a first portion and a second portion, the first portion and the second portion collectively defining the inner housing surface; and wherein the first portion is securable to the second portion.

In Example 11, the subject matter of Example 10 includes, wherein: the first portion of the housing includes a first pair of coupling flanges, the first pair of coupling flanges defining a first plurality of bores; and the second portion of the housing includes defines a second pair of coupling flanges, the second pair of coupling flanges defining a second plurality of bores, wherein the first plurality of bores and the second plurality of bores are configured to concurrently receive a plurality of fasteners there through to secure the first portion to the second portion.

In Example 12, the subject matter of Examples 1-11 includes, wherein the inner housing surface defines a friction inducing texture adapted to engage the outer liner surface to help prevent lateral and rotational movement between the liner and the housing.

In Example 13, the subject matter of Examples 1-12 includes, wherein the liner is made from a polymeric or elastomeric material and the housing is made from a metallic material.

Example 14 is a free-mold stator for a progressing cavity pump, the free-mold stator comprising: a housing including an inner housing surface defining an uninterrupted helical profile; and a liner including an inner liner surface and an outer liner surface, the inner liner surface defining an uninterrupted helical profile and the outer liner surface defining a substantially uninterrupted helical profile, wherein the liner includes, an anchor portion extending radially outward from the outer liner surface, the anchor portion adapted to prevent rotational movement between the liner and the housing.

In Example 15, the subject matter of Example 14 includes, wherein the housing includes a first portion and a second portion, the first portion and the second portion collectively defining the inner housing surface.

In Example 16, the subject matter of Example 15 includes, wherein: the liner a first liner end defining a first flange extending radially outward beyond the outer liner surface and a second liner end defining a second flange extending radially outward beyond the outer liner surface; the housing includes a first extension extending radially outward beyond an outer housing surface and in contact with the first flange, the first extension adapted to support the first flange; and the housing includes a second extension extending radially outward beyond the outer housing surface and in contact with the second flange, the second extension adapted to support the second flange.

In Example 17, the subject matter of Example 16 includes, wherein the free-mold stator is positioned between a first compression element and a second compression element of a progressing cavity pump; and wherein: the first compression element is adapted to compress the first flange of the liner against the first extension of the housing to help prevent lateral and rotational movement between the liner and the housing, the first compression element including a first tapered surface; and the second compression element is adapted to compress the second flange of the liner against the second extension of the housing to help prevent lateral and rotational movement between the liner and the housing, the second compression element including a second tapered surface.

In Example 18, the subject matter of Example 17 includes, wherein the first flange defines a first cam surface adapted to slidingly engage the first tapered surface of the first compression element when the first flange is compressed against the first extension of the housing by the first compression element; and the second flange defines a second cam surface adapted to slidingly engage the second tapered surface of the second compression element when the second flange is compressed against the second extension of the housing by the second compression element.

In Example 19, the subject matter of Example 18 includes, a first clamping element adapted to receive the first extension of the housing; a second clamping element adapted to receive the second extension of the housing, the first clamping element and the second clamping element adapted to secure the first portion of the housing to the second portion of the housing and compressively clamp the anchor portion therebetween.

In Example 20, the subject matter of Example 19 includes, wherein the progressing cavity pump includes: a third compression element adapted to receive the first compression element; a first plurality of fasteners extending longitudinally between the first clamping element and the third compression element, the first plurality of fasteners adapted to bias the first clamping element toward the first compression element to compress the second flange between the first extension of the housing and the first compression element; and a second plurality of fasteners extending longitudinally between the second clamping element and the second compression element, the second plurality of fasteners adapted to bias the second clamping element toward the second compression element to compress the second flange between the second extension of the housing and the second compression element.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20.

Example 23 is a system to implement of any of Examples 1-20.

Example 24 is a method to implement of any of Examples 1-20.

What is claimed is:

1. A free-mold stator for a progressing cavity pump, the free-mold stator comprising:

a housing including an inner housing surface defining an uninterrupted helical profile, wherein the housing includes at least two radial sections; and a liner including an inner liner surface and an outer liner surface, the inner liner surface and the outer liner surface each defining an uninterrupted helical profile, wherein:

the inner housing surface is adapted to receive the outer liner surface to prevent rotational movement between the liner and the housing, the liner is circumferentially continuous, and at least one end of the liner includes a flange extending radially outward beyond the outer liner surface.

2. The free-mold stator of claim 1, wherein the liner includes:

a first liner end and a second liner end;

a longitudinal length defined between the first liner end and the second liner end; and a thickness defined between the outer liner surface and the inner liner surface, wherein the thickness is even throughout the longitudinal length.

3. The free-mold stator of claim 2, wherein:

the first liner end includes a first flange extending radially outward beyond the outer liner surface; and the second liner end includes a second flange extending radially outward beyond the outer liner surface.

4. The free-mold stator of claim 3, wherein the housing includes:

a first extension extending radially outward beyond an outer housing surface and in contact with the first flange, the first extension adapted to support the first flange; and a second extension extending radially outward beyond the outer housing surface and in contact with the second flange, the second extension adapted to support the second flange.

5. The free-mold stator of claim 4, wherein the free-mold stator is positioned between a first compression element and a second compression element of a progressing cavity pump; and wherein:

the first compression element is adapted to compress the first flange of the liner against the first extension of the housing to help prevent lateral and rotational movement between the liner and the housing, the first compression element including a first tapered surface; and the second compression element is adapted to compress the second flange of the liner against the second extension of the housing to help prevent lateral and rotational movement between the liner and the housing, the second compression element including a second tapered surface.

6. The free-mold stator of claim 5, wherein:

the first flange defines a first cam surface adapted to slidingly engage the first tapered surface of the first compression element when the first flange is compressed against the first extension of the housing by the first compression element; and the second flange defines a second cam surface adapted to slidingly engage the second tapered surface of the second compression element when the second flange is compressed against the second extension of the housing by the second compression element.

7. The free-mold stator of claim 6, wherein:

the first compression element defines a first end surface adapted to contact the first extension of the housing to limit compression of the first flange between the first compression element and the first extension; and the second compression element defines a second end surface adapted to contact the second extension of the housing to limit compression of the second flange between the second compression element and the second extension.

8. The free-mold stator of claim 6, wherein:

the first extension of the housing includes a first projection extending toward the first liner end and the first compression element, the first projection adapted to contact a first annular surface defined by the first compression element; and the second extension of the housing includes a second projection extending toward the second liner end and the second compression element, the second projection adapted to contact a second annular surface defined by the second compression element.

9. The free-mold stator of claim 8, comprising:

a third compression element adapted to circumferentially encompass an end portion of the first compression element; and a plurality of tie rods extending longitudinally between the second compression element and the third compression element, the plurality of tie rods adapted to bias the second compression element toward the third compression element to cause:

the first compression element to compress the first flange against the first extension; and the second compression element to compress the second flange against the second extension.

10. The free-mold stator of claim 1, wherein the housing includes a first portion and a second portion, the first portion and the second portion collectively defining the inner housing surface; and wherein the first portion is securable to the second portion.

11. The free-mold stator of claim 10, wherein:

the first portion of the housing includes a first pair of coupling flanges, the first pair of coupling flanges defining a first plurality of bores; and the second portion of the housing includes a second pair of coupling flanges, the second pair of coupling flanges defining a second plurality of bores, wherein the first plurality of bores and the second plurality of bores are configured to concurrently receive a plurality of fasteners there through to secure the first portion to the second portion.

12. The free-mold stator of claim 1, wherein the inner housing surface defines a friction inducing texture adapted to engage the outer liner surface to help prevent lateral and rotational movement between the liner and the housing.

13. The free-mold stator of claim 1, wherein the liner is made from a polymeric or elastomeric material and the housing is made from a metallic material.

14. A free-mold stator for a progressing cavity pump, the free-mold stator comprising:

a housing including an inner housing surface defining an uninterrupted helical profile; and a liner including an inner liner surface and an outer liner surface, the inner liner surface defining an uninterrupted helical profile and the outer liner surface defining a substantially uninterrupted helical profile, wherein the liner includes a first liner end and a second liner end; wherein the liner includes an anchor portion arranged between the first liner end and the second liner end extending radially outward from the outer liner surface separate from the substantially uninterrupted helical profile, the anchor portion adapted to prevent rotational movement between the liner and the housing.

15. The free-mold stator of claim 14, wherein the housing includes a first portion and a second portion, the first portion and the second portion collectively defining the inner housing surface.

16. The free-mold stator of claim 15, wherein:

the liner includes a first liner end defining a first flange extending radially outward beyond the outer liner surface and a second liner end defining a second flange extending radially outward beyond the outer liner surface;

the housing includes a first extension extending radially outward beyond an outer housing surface and in contact with the first flange, the first extension adapted to support the first flange; and the housing includes a second extension extending radially outward beyond the outer housing surface and in contact with the second flange, the second extension adapted to support the second flange.

17. The free-mold stator of claim 16, wherein the free-mold stator is positioned between a first compression element and a second compression element of a progressing cavity pump; and wherein:

the first compression element is adapted to compress the first flange of the liner against the first extension of the housing to help prevent lateral and rotational movement between the liner and the housing, the first compression element including a first tapered surface; and the second compression element is adapted to compress the second flange of the liner against the second extension of the housing to help prevent lateral and rotational movement between the liner and the housing, the second compression element including a second tapered surface.

18. The free-mold stator of claim 17, wherein:

the first flange defines a first cam surface adapted to slidingly engage the first tapered surface of the first compression element when the first flange is compressed against the first extension of the housing by the first compression element; and the second flange defines a second cam surface adapted to slidingly engage the second tapered surface of the second compression element when the second flange is compressed against the second extension of the housing by the second compression element.

19. The free-mold stator of claim 18, further comprising:

a first clamping element adapted to receive the first extension of the housing; and a second clamping element adapted to receive the second extension of the housing, the first clamping element and the second clamping element adapted to secure the first portion of the housing to the second portion of the housing and compressively clamp the anchor portion therebetween.

20. The free-mold stator of claim 19, wherein the progressing cavity pump includes:

a third compression element adapted to receive the first compression element;

a first plurality of fasteners extending longitudinally between the first clamping element and the third compression element, the first plurality of fasteners adapted to bias the first clamping element toward the first compression element to compress the second flange between the first extension of the housing and the first compression element; and a second plurality of fasteners extending longitudinally between the second clamping element and the second compression element, the second plurality of fasteners adapted to bias the second clamping element toward the second compression element to compress the second flange between the second extension of the housing and the second compression element.

* * * * *